US006428237B1

(12) United States Patent
Duckett

(10) Patent No.: US 6,428,237 B1
(45) Date of Patent: Aug. 6, 2002

(54) NON-REDIRECTIVE GATING CRASH CUSHION APPARATUS FOR MOVABLE, PERMANENT AND PORTABLE ROADWAY BARRIERS

(75) Inventor: John W. Duckett, Carson City, NV (US)

(73) Assignee: Barrier Systems, Inc., Rio Vista, CA (US)

( * ) Notice: Subject to any disclaimer, the term of this patent is extended or adjusted under 35 U.S.C. 154(b) by 0 days.

(21) Appl. No.: 09/684,111

(22) Filed: Oct. 6, 2000

(51) Int. Cl.[7] ..... E01F 9/00; E01F 15/00
(52) U.S. Cl. ..... 404/6; 404/10; 256/13.1
(58) Field of Search ..... 404/6, 9, 10; 256/13.1; 188/377

(56) References Cited

U.S. PATENT DOCUMENTS 4,321,989 A * 3/1982 Meinzer ..... 188/377
4,681,302 A * 7/1987 Thompson ..... 256/13.1
5,336,016 A * 8/1994 Baatz ..... 404/6
5,443,324 A * 8/1995 Sullivan ..... 404/6
5,494,371 A * 2/1996 Oberth et al. ..... 404/6
5,577,861 A * 11/1996 Oberth et al. ..... 404/6
5,779,389 A * 7/1998 Niemerski ..... 404/6
6,089,782 A * 7/2000 Bligh et al. ..... 404/6
6,179,516 B1 * 1/2001 Ivey et al. ..... 404/6

* cited by examiner

*Primary Examiner*—Gary S. Hartmann
(74) *Attorney, Agent, or Firm*—Thomas R. Lampe

(57) ABSTRACT

Crash cushion apparatus for a roadway barrier includes a noseplace assembly, one or more impact absorption elements, and a transition/attachment assembly. The impact absorption elements, and include containers with collapsible sides having different numbers of vertical indentations used to control wall collapse.

9 Claims, 4 Drawing Sheets

NON-REDIRECTIVE GATING CRASH CUSHION APPARATUS FOR MOVABLE, PERMANENT AND PORTABLE ROADWAY BARRIERS

DESCRIPTION

1. Technical Field

This invention relates generally to roadway barriers, and more specifically to an improved non-redirective gating crash cushion apparatus for all types of roadway barriers including moveable, permanent and portable barriers.

2. Background Art

Non-redirective, gating, crash cushions are highway safety devices whose primary function is to improve the safety for occupants of errant vehicles that impact the end of rigid or semi-rigid barriers or fixed roadside hazards by absorbing the kinetic energy of impact or by allowing controlled penetration or gating of the vehicle. These devices are designed to safely capture or change the direction of an errant vehicle away from roadside or median hazards. These types of systems are typically applied to locations where redirective type impacts are very unlikely to occur.

DISCLOSURE OF INVENTION

The crash cushion apparatus of this invention provides an improved non-redirective gating crash cushion apparatus for all types of roadway barriers including moveable, permanent and portable barriers. The inventive apparatus preferably includes a nosepiece assembly, at least one and preferably a plurality of impact absorption elements or modules, and a transition/attachment assembly. The number Of impact absorption elements to be utilized in a particular application is based upon the performance level needed (i.e., the design speed and capacity). The transition/attachment assembly varies with respect to the type of roadway barrier being used, and to which the inventive apparatus is attached.

The impact absorption elements are composed of a plastic container, steel side bars, end plate/hinge assemblies, an evaporation prevention cap with tether, and appropriate fasteners. The first element of the assembled system is preferably left empty of fluid with the evaporation prevention cap installed. All other elements of the system should be filled with fluid in accordance with the installation instructions, and the evaporation prevention caps should be securely installed.

The impact absorption elements each have a forward end and a rearward end, one end (e.g., the forward end) preferably bearing an end-piece with a moveable linkage for attachment to the rear of another element, and the other end (e.g., the rearward end) preferably having no such linkage. Each impact absorption element has two sides, each side bearing at least one vertical indentation, with one side bearing a first number of vertical indentations (e.g., n=1, where n is the number of indentations on a side), and the other side bearing at least one more vertical indentation than the first side (e.g., n=2 or more). In the preferred embodiment, one side bears one vertical indentation, while the other side bears two vertical indentations, each one of those offset from the single vertical indentation on the other side.

When a plurality of impact absorption elements are assembled, the elements should be arranged so that adjacent elements alternate the number of vertical indentations on their respective sides, e.g., if the first element in the assembled system has one vertical indentation on the right side, the adjacent (second) element should have two vertical indentations on its right side, the next (third) element should have one vertical element in its right side, and so forth. The left sides of the assembled system would thus also have alternating numbers of vertical indentations in their sides, e.g., two in the first, one in the second, two in the third, and so forth.

This arrangement of asymmetry in the number of vertical indentations in the opposite sides of an individual impact absorption element, and the alternating of the number of vertical indentations on the same sides of adjacent elements yields desirable and beneficial energy-absorbing deformation characteristics for the individual elements, as well as the assembled system. Specifically, due to this arrangement of asymmetry the elements tend to compress in a non-linear (e.g., zig-zag) fashion upon longitudinal impact, imparting a beneficial energy-absorbing movement to the assembled elements. This causes an effective short column buckle to form, instead of the long column going into long column (Euler) buckling.

The inventive system is also easy to install, and is easier to restore after an impact than other non-redirective crash cushions. For example, sand barrel arrays are significantly wider, and are considerably more difficult to clean and reinstall after a vehicle impact. Non-energy absorbing terminals utilizing an aluminum "box" with internal cells are more costly, and do not provide the equivalent level of energy absorption as the instant invention.

BEST MODE FOR CARRYING OUT THE INVENTION

Figure 1:
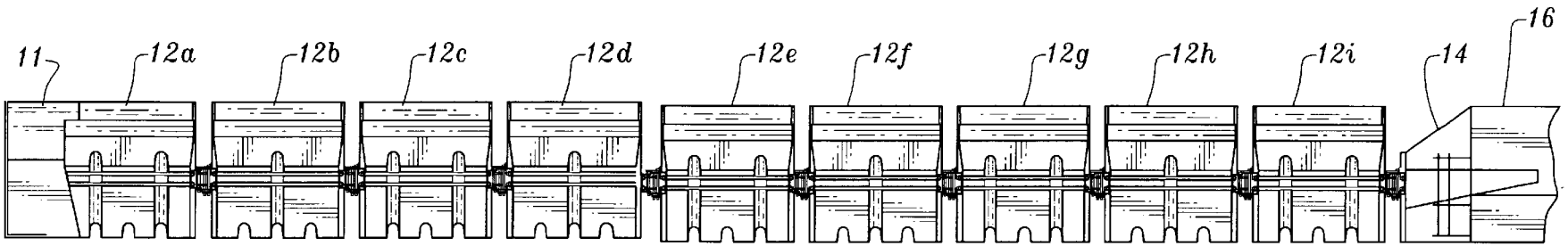
FIG. 1 is a side elevation view of a nine impact absorption element embodiment of the crash cushion apparatus of this invention as attached to a permanent or portable concrete barrier.

FIG. 1 is a side elevation view of a nine impact absorption element embodiment of the crash cushion apparatus 10 of this invention as attached to a permanent or portable concrete barrier. This view illustrates a nose piece assembly 11, a series of nine impact absorption modules 12(*a*)–12(l), a transition/attachment assembly 14, all attached to a permanent or portable concrete barrier 16.

Figure 2:
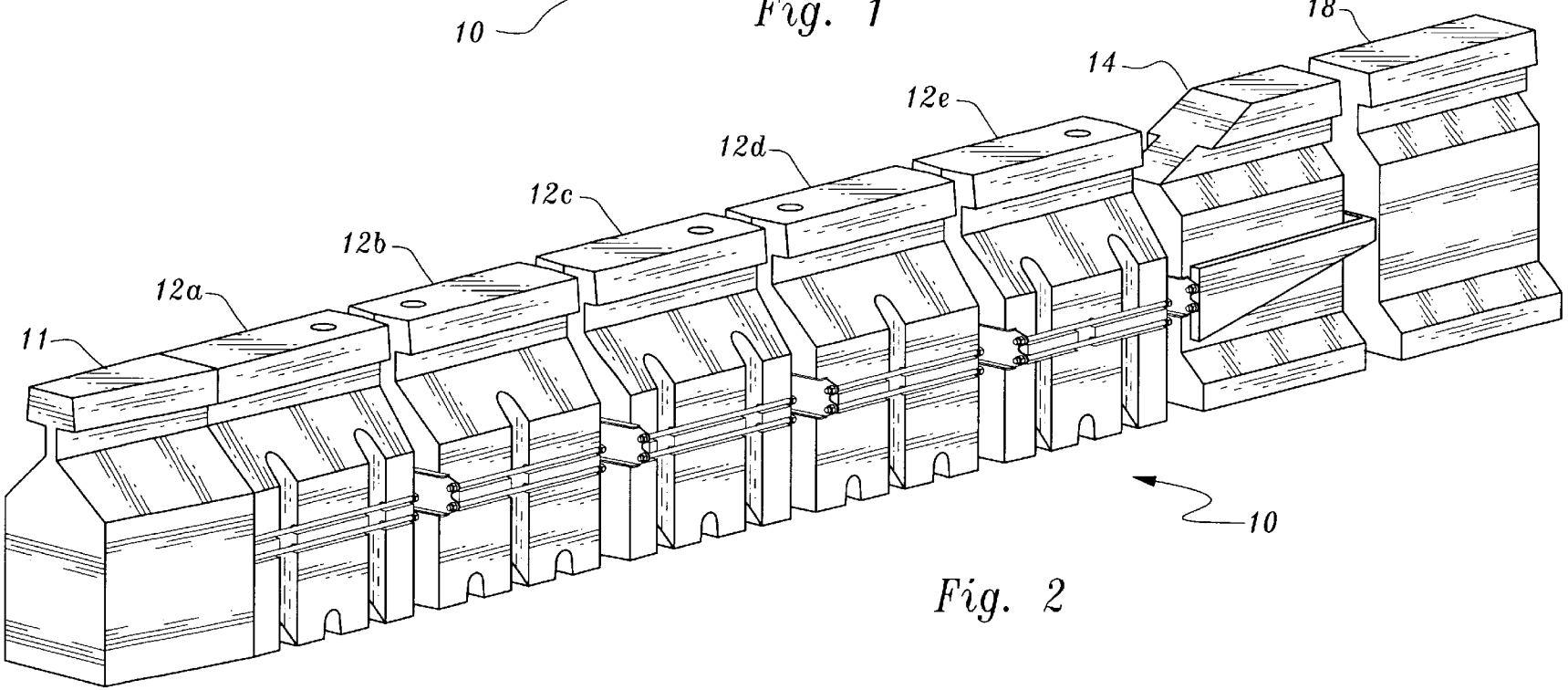
FIG. 2 is a perspective view of a five impact absorption element embodiment of the crash cushion apparatus of this invention as attached to a moveable roadway barrier system.

FIG. 2 is a perspective view of a five impact absorption element embodiment of the crash cushion apparatus 10 of this invention as attached to a moveable roadway barrier system 18. This view again illustrates a nose piece assembly 11, this time with a series of five impact absorption elements or modules 12(*a*)–12(*e*), and transition/attachment assembly 14 for attaching the modules to the moveable barrier chain 18.

Figure 3:
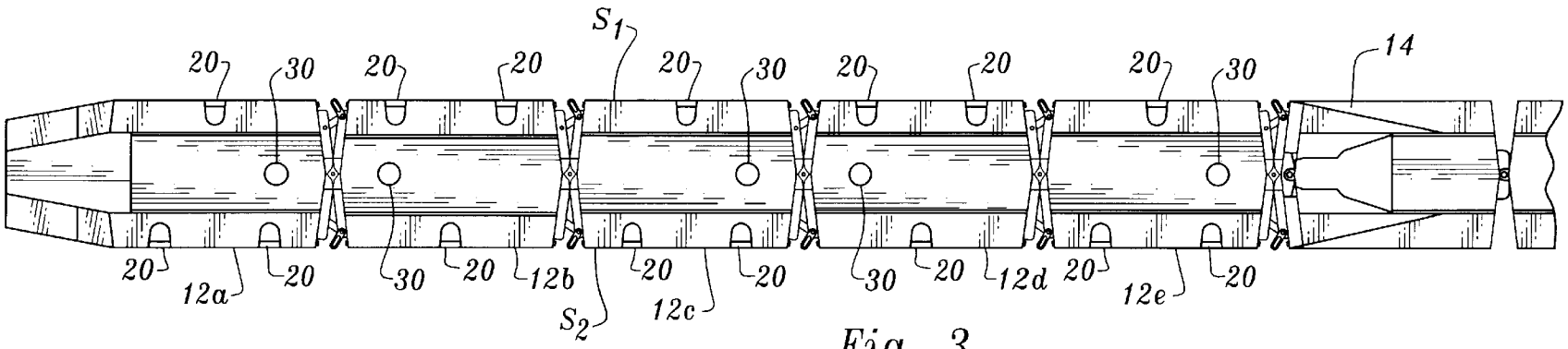
FIG. 3 is a top plan view of the five impact absorption element embodiment of FIG. 2.

FIG. 3 is a top plan view of the five impact absorption element embodiment of FIG. 2. This view illustrates the preferred arrangement of adjacent elements such that the first element 12(*a*) has one vertical indentation 20 on one side S1 of the assembled apparatus, and two vertical indentations 20 on the other side S2 of the assembled apparatus. The next element 12(*b*) exhibits two vertical indentations 20 on side Si of the assembled apparatus, and one vertical indentation 20 on the other side S2; the next element 12(*c*) has one vertical indentation 20 on side S1 and two on side S2, and so on. This view also illustrates the preferred alternating locations of the vent/fill hole 30 in each of the elements 12(*a*)–12(*e*).

Figure 4:
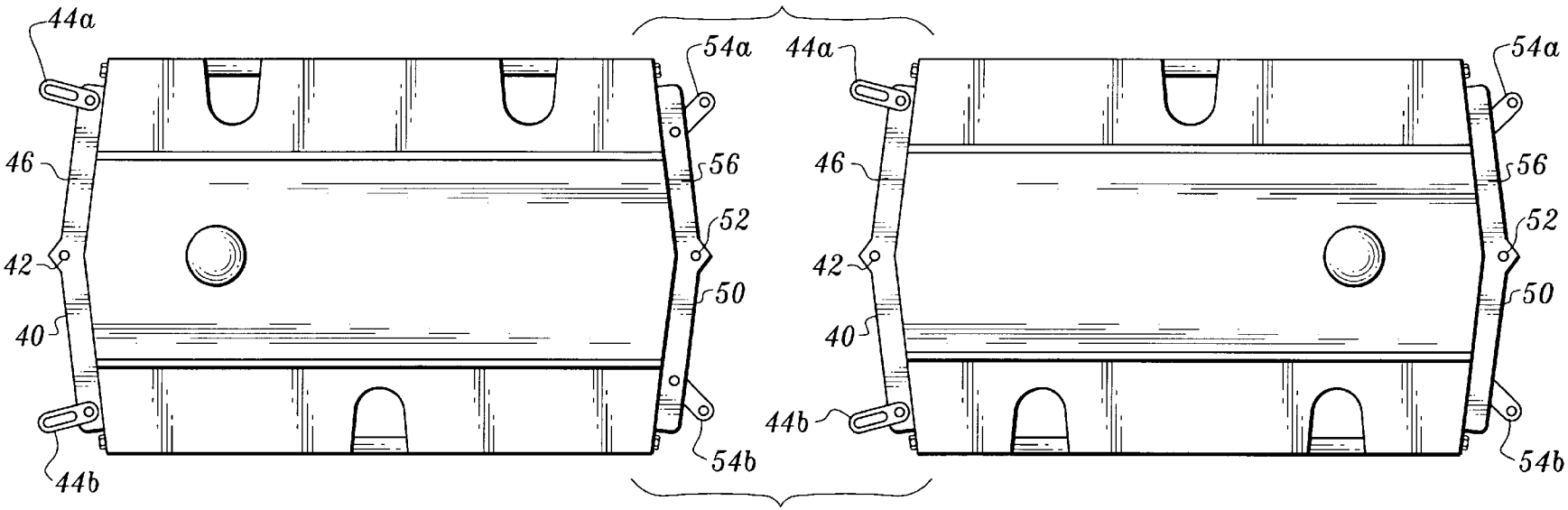
FIG. 4 is a top plan view of two adjacent impact absorption elements.

FIG. 4 is a top plan view of two adjacent impact absorption elements. This view illustrates the connecting hardware between adjacent elements. Each module may include a front bracket assembly 40 bearing a front center pivot hole 42 and a pair of outboard slotted links 44(*a*), (*b*) on the front 46 of the module (i.e., towards the nose piece of the assembled apparatus), adapted for connection with a rear bracket assembly 50 bearing a complementary rear center pivot hole 52 and outboard pin receiving holes 54(*a*), (*b*) on the rear 56 of the adjacent module (i.e., towards the transition piece).

Figure 5:
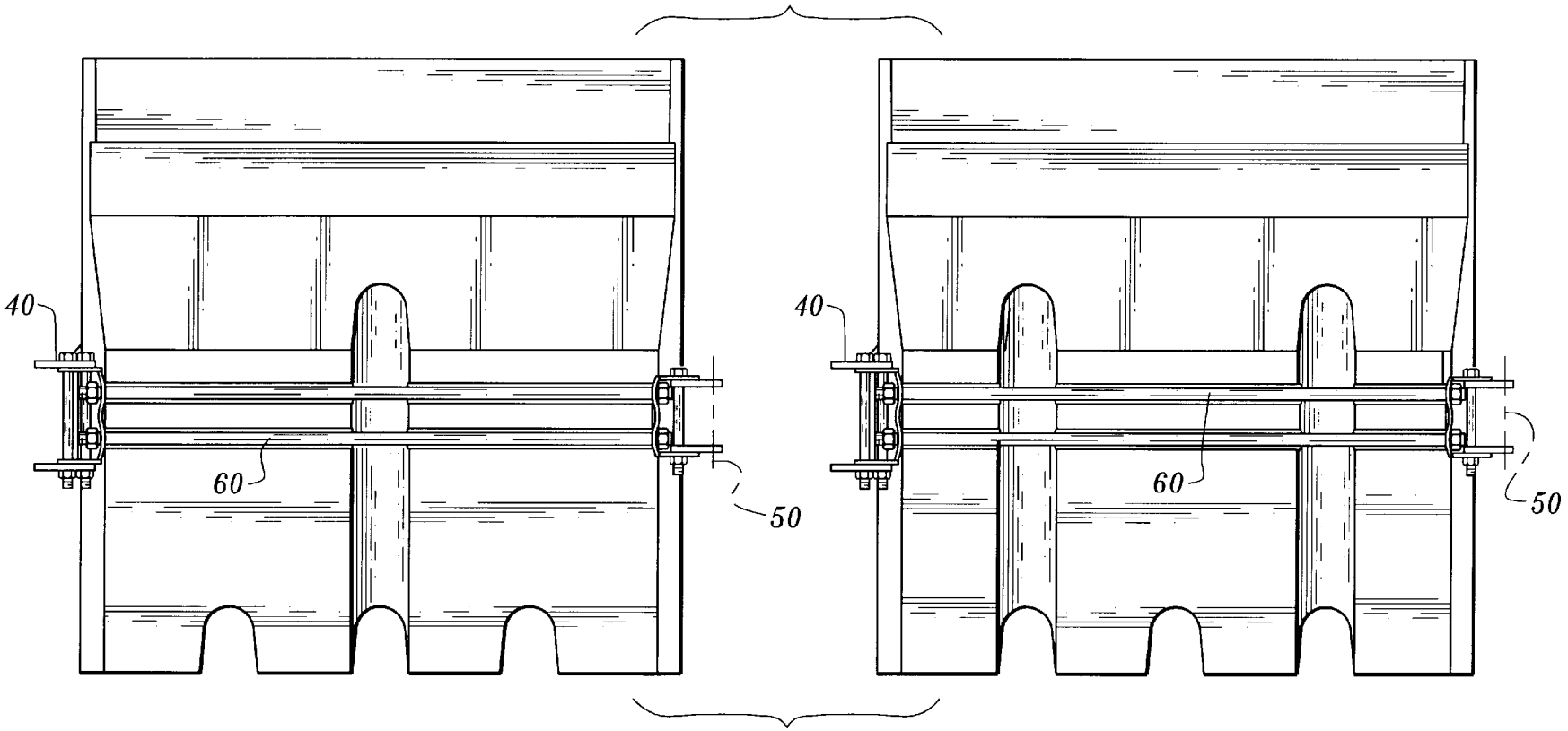
FIG. 5 is a side elevation view of the two adjacent impact absorption elements of FIG. 4.

FIG. 5 is a side elevation view of the two adjacent impact absorption elements of FIG. 4. This view illustrates the steel side bars 60 that preferably extend along both sides of the modules, and are themselves connected to the front and rear brackets assemblies 40 and 50, respectively.

Figure 6:
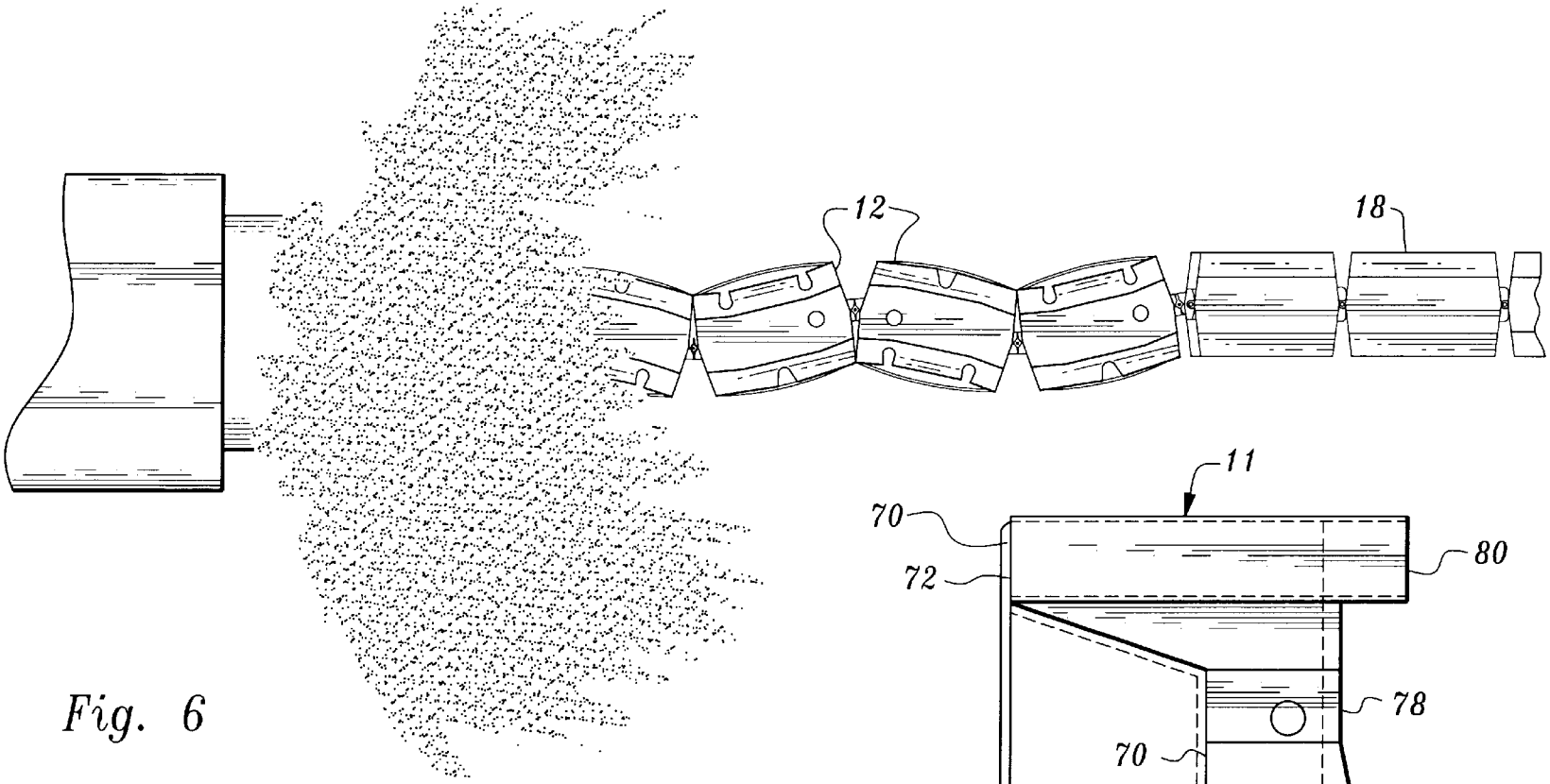
FIG. 6 is a top plan view of a crash cushion apparatus of this invention after a typical impact, illustrating the desired element energy-absorbing characteristics.

FIG. 6 is a top plan view of a crash cushion apparatus of this invention after a typical impact, illustrating the desired element energy-absorbing deformation characteristics. As discussed supra, the assembled elements 12 preferably compress in a non-linear fashion upon longitudinal impact, causing an effective short column buckle to form.

A typical impact absorption element may have an effective length of one meter, and an effective overall height of 800 mm. The effective width of the upright portion of each section may be 61 cm. Each section is preferably fabricated out of a roto-molded shell that is filled with water and fitted with steel hardware to allow the sections to be connected. The mass of each section is approximately 50 kg (110 pounds) empty and 325 kg (717 pounds) filled (approximately 300 liters/80 gallons per element). The attachment to a moveable barrier system is designed to allow the barrier to move through a barrier transfer machine. The upper portion of each section of the system is preferably "T" shaped to accommodate lifting rollers on the barrier transfer machine that is used to laterally transfer the standard movable barrier on the roadway surface. The vertical indentations 20 on each side of the modules preferably extend the entire height of the side wall, and are of appropriate dimension (e.g., 10 cm +/–, semi-circular in cross-section, or any other appropriate size and shape according the particular embodiment) to enable the desired deformation and asymmetrical collapse of the modules.

Figure 7:
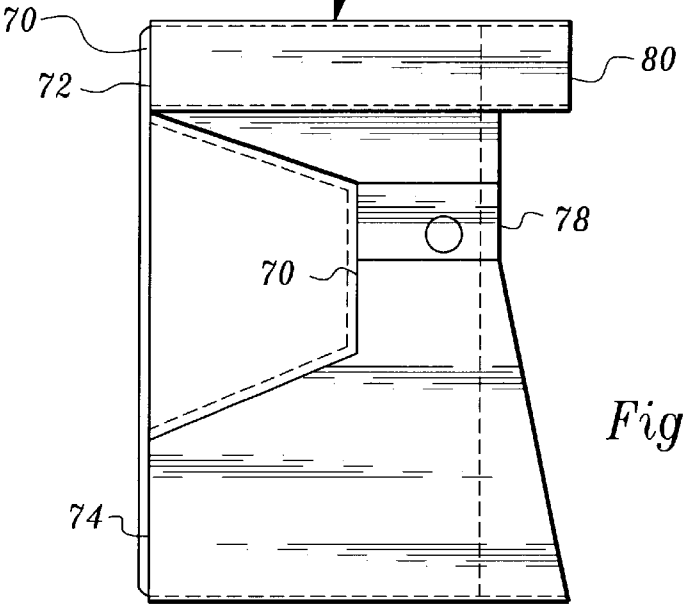
FIG. 7 is a side elevation view of a nose piece used in the crash cushion apparatus of this invention.

FIG. 7 is a side elevation view of a nose piece 11 used in the crash cushion apparatus of this invention. Nose piece 11 is preferably of the general size and shape of the impact absorption modules to which it is attached, but with a frontal section 70 having forward-extending top and bottom portions 72, 74, respectively, relative to medial portion 76. This C-shaped configuration is designed such that an impacting vehicle is captured between the top and bottom portions, and the vertical and horizontal movement of the impacting vehicle is able to be directed in a controlled manner by the impact absorption modules of the inventive apparatus. Frontal section 70 may include a medial panel or surface which can be used to attach appropriate delineation as required, but is easily deformed by an impacting vehicle. Rear section 78 includes appropriate connection hardware 80 for connecting the nose piece 11 to the first impact absorption element 12(*a*).

Typical installation instructions for the crash cushion apparatus of this invention may include, but not be limited to the following:

The system should be installed on a firm surface that is not likely to allow the filled elements to become embedded below grade in inclement weather. In regions where the water filled elements could become frozen, proper antifreeze agents should be used. The elements should be inspected regularly to ensure that the elements that are intended to contain water (or antifreeze fluid) are kept at adequate fill levels, and to ensure that all connections between the nosepiece, the elements and the transition/attachment hardware remain intact and in accordance with specifications.

When the system is attached to a moveable barrier system, it is necessary to ensure that there are a minimum number of moveable barrier elements (e.g., ten) properly connected downstream of the system. Placement and use of the system should be in accordance with all national, regional and local standards.

When a system is assembled, it is important to ensure that the elements are assembled in an alternating fashion. Thus, when you look down either side of the assembled system, you should see an alternating pattern of vertical indentations (e.g., two, one, two, one, etc.). The number of elements connected between the nosepiece and the transition/attachment assemblies affects the capacity of the system. There are three connections between each set of elements. These connections should be made with either locking pins or bolts with locking nuts to ensure that the system elements remain connected in the highway environment. The first element in all systems must be attached to the nosepiece assembly with three bolts or locking pins, and must always be kept empty of fluid. The other elements must always be kept filled with fluid. The metal components and fasteners of the system should be periodically inspected to ensure that the system remains intact and able to perform in a safe and effective manner.

The nosepiece assembly is a single component that must be intact and properly attached to the system. The nosepiece has a vertical surface that is relatively flat that can be used to attach appropriate traffic control signage. After an impact on the system, the system should be inspected to ensure that the nosepiece assembly is intact.

There are two types of transition/attachment assemblies. One type is designed for attachment to moveable barrier systems, and the other type is designed for attachment to permanent or portable concrete barriers. The attachment between the last impact absorption element and the transition/attachment assembly must be made with either locking pins or bolts with locking nuts. The attachment between the transition/attachment assembly and a moveable barrier system should be made with the standard pins used to attach one moveable barrier to another. The attachment between the transition/attachment assembly and a permanent or portable concrete barrier should be made in accordance with specifications. The system should be assembled and aligned on the site before the transition/attachment assembly is attached to the permanent or portable concrete median barrier element. The transition/attachment assembly should be periodically inspected to ensure that all connections between the last impact absorption element and the transition/attachment assembly, and between this assembly and the barrier element behind the system are secure for the system to perform in an acceptable manner.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and their legal equivalents.

What is claimed as invention is:

1. Crash cushion apparatus for roadway barriers including moveable, permanent and portable barriers, said crash cushion apparatus comprising, in combination:

a nosepiece;

one or more impact absorption elements connected to said nosepiece, each impact absorption element including a container having a forward end, a rearward end, and two deformable sides extending between said forward end and said rearward end, each deformable side having at least one vertical indentation, with one deformable side having at least one more vertical indentation than the other of said deformable sides; and a transition/attachment assembly connected to said one or more impact absorption elements and adapted for connection to a roadway barrier, said one or more impact absorption elements being deformable to absorb energy when opposed forces are applied to the forward and rearward ends thereof with the forward and rearward ends at the deformable side thereof having at least one more vertical indentation than the other of the deformable sides thereof being closer together after application of said opposed forces than the forward and rearward ends at the other of the deformable sides thereof.

2. Crash cushion apparatus for roadway barriers including moveable, permanent and portable barriers, said crash cushion apparatus comprising, in combination:

a nosepiece;

one or more impact absorption elements connected to said nosepiece, each impact absorption element including a container having a forward end, a rearward end, and two deformable sides extending between said forward end and said rearward end, each deformable side having at least one vertical indentation, with one deformable side having at least one more vertical indentation than the other of said deformable sides; and a transition/attachment assembly connected to said one or more impact absorption elements and adapted for connection to a roadway barrier, said one or more impact absorption elements being deformable to absorb energy when opposed forces are applied to the forward and rearward ends thereof with the deformable side thereof having at least one more vertical indentation than the other of the deformable sides thereof being concavely deformed upon application of said opposed forces.

3. The crash cushion apparatus according to claim 2 wherein said nosepiece includes a frontal section having a forward-extending top portion, a forward extending bottom portion and a medial portion between said top portion and said bottom portion, said top portion, said bottom portion and said medial portion being fixedly interconnected and forming a C-shaped configuration for capturing an impacting vehicle between said top portion and said bottom portion and in front of said medial portion.

4. The crash cushion apparatus of claim 2 wherein the container of each impact absorption element is formed of molded plastic and wherein said vertical indentations extend substantially the full height of said deformable sides.

5. The crash cushion apparatus according to claim 2 including a plurality of impact absorption elements connected together end to end to form a double-sided assembly of impact absorption elements between said nosepiece and said transition/attachment assembly, said impact absorption elements arranged so that adjacent impact absorption elements have different numbers of vertical indentations located at the sides of said double-sided assembly of impact absorption elements.

6. The crash cushion apparatus of claim 5 additionally comprising connector means for interconnecting said impact absorption elements to form said double-sided assembly of impact absorption elements and cooperable with said impact absorption elements to form a non-linear pattern of impact absorption elements upon application of said opposed forces.

7. The crash cushion apparatus according to claim 6 wherein said connector means includes a front bracket assembly and a rear bracket assembly located respectively at the forward end and the rearward end of each impact absorption element and connector pins pivotally interconnecting front bracket assemblies and rear bracket assemblies of adjacent impact absorption elements.

8. The crash cushion apparatus according to claim 7 wherein said connector means includes links disposed between and interconnecting the front bracket assembly and rear bracket assembly of adjacent impact absorption elements.

9. The crash cushion apparatus according to claim 7 additionally comprising side bars extending between the front bracket assembly and the rear bracket assembly of each of said impact absorption elements and extending along the sides thereof.

* * * * *